US007410158B2

(12) United States Patent
Iida et al.

(10) Patent No.: US 7,410,158 B2
(45) Date of Patent: Aug. 12, 2008

(54) IMAGE FORMING APPARATUS AND METHOD

(75) Inventors: Junichi Iida, Kanagawa (JP); Hiroki Okada, Kanagawa (JP); Junichi Tokita, Kanagawa (JP); Kenji Yamada, Tokyo (JP); Hiromoto Saitoh, Kanagawa (JP); Shuuya Nagasako, Tokyo (JP); Naohiro Kikkawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/682,238

(22) Filed: Mar. 5, 2007

(65) Prior Publication Data

US 2007/0147922 A1 Jun. 28, 2007

Related U.S. Application Data

(62) Division of application No. 10/819,197, filed on Apr. 7, 2004, now abandoned.

(30) Foreign Application Priority Data

Apr. 9, 2003 (JP) ..... 2003-105566
Feb. 5, 2004 (JP) ..... 2004-029559

(51) Int. Cl.
*B65H 37/04* (2006.01)

(52) U.S. Cl. ..... 270/58.09; 270/32; 270/39.06; 270/39.07; 270/58.18; 270/58.1; 270/58.11; 270/58.13

(58) Field of Classification Search ..... 270/32, 270/37, 39, 39.06, 39.07, 58.09, 58.18, 58.1, 270/58.11, 58.12, 58.13
See application file for complete search history.

(56) References Cited

U.S. PATENT DOCUMENTS

| | | | |
|---|---|---|---|
| 5,078,376 | A | 1/1992 | Yamada et al. |
| 5,263,697 | A | 11/1993 | Yamazaki et al. |
| 5,508,798 | A | 4/1996 | Yamada |
| 5,551,686 | A | 9/1996 | Sanchez et al. |
| 5,762,328 | A | 6/1998 | Yamada et al. |
| 6,145,825 | A | 11/2000 | Kunihiro et al. |

(Continued)

FOREIGN PATENT DOCUMENTS

| | | |
|---|---|---|
| JP | 09-183558 | 7/1997 |

(Continued)

*Primary Examiner*—Gene O. Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A copy machine achieves a reduction in power consumption when performing a saddle-stitching operation. An image forming unit forms visible images on recording sheets in accordance with image data stored in a memory device. A post-processing unit collects the recording media on an individual copy basis to prepare a bundle of the recording sheets, and performs a saddle-stitching process and a center-folding process on the bundle of the recording sheets. The post-processing unit ejects the processed recording sheets onto a predetermined eject tray. A system control part determines whether or not a total number of the recording sheets corresponding to the image data is within a limit number for the saddle-stitching process. When the total number of the recording sheets exceeds the limit number for the saddle-stitching process, the recording sheets are ejected onto the at least one eject tray other than a predetermined eject tray.

6 Claims, 4 Drawing Sheets

U.S. PATENT DOCUMENTS

| | | | | |
|---|---|---|---|---|
| 6,188,868 | B1 | 2/2001 | Shiramura | |
| 6,199,853 | B1 | 3/2001 | Andoh et al. | |
| 6,220,592 | B1 * | 4/2001 | Watanabe et al. | 271/241 |
| 6,231,045 | B1 | 5/2001 | Yamada et al. | |
| 6,264,191 | B1 | 7/2001 | Suzuki et al. | |
| 6,296,247 | B1 | 10/2001 | Tamura et al. | |
| 6,322,070 | B2 | 11/2001 | Yamada et al. | |
| 6,343,785 | B1 | 2/2002 | Yamada et al. | |
| 6,394,448 | B2 | 5/2002 | Suzuki et al. | |
| 6,416,052 | B2 | 7/2002 | Yamada et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,631,896 | B2 | 10/2003 | Yamada et al. | |
| 6,698,744 | B2 | 3/2004 | Yamada et al. | |
| 6,712,349 | B2 | 3/2004 | Watanabe | |
| 6,783,124 | B2 | 8/2004 | Tamura et al. | |
| 6,832,759 | B2 | 12/2004 | Nagasako et al. | |
| 6,871,851 | B2 | 3/2005 | Tamura et al. | |
| 6,889,974 | B2 | 5/2005 | Tamura et al. | |
| 6,905,118 | B2 | 6/2005 | Yamada et al. | |
| 6,921,069 | B2 | 7/2005 | Suzuki et al. | |
| 6,957,810 | B2 | 10/2005 | Yamada et al. | |
| 6,986,511 | B2 | 1/2006 | Yamada et al. | |
| 6,988,729 | B2 | 1/2006 | Tamura et al. | |
| 7,014,183 | B2 | 3/2006 | Tamura et al. | |
| 7,090,213 | B2 | 8/2006 | Suzuki et al. | |
| 7,137,625 | B2 | 11/2006 | Yamada et al. | |
| 7,207,556 | B2 | 4/2007 | Saitoh et al. | |
| 2003/0215275 | A1 | 11/2003 | Tamura et al. | |
| 2003/0219295 | A1 * | 11/2003 | Saitoh et al. | 399/410 |
| 2004/0104525 | A1 | 6/2004 | Suzuki et al. | |
| 2006/0055100 | A1 | 3/2006 | Suzuki et al. | |
| 2006/0120783 | A1 | 6/2006 | Tokita et al. | |
| 2006/0120784 | A1 | 6/2006 | Iida et al. | |
| 2006/0180999 | A1 | 8/2006 | Suzuki et al. | |
| 2007/0056423 | A1 | 3/2007 | Yamada et al. | |

FOREIGN PATENT DOCUMENTS

| | | |
|---|---|---|
| JP | 11-151837 | 6/1999 |
| JP | 11-189365 | 7/1999 |
| JP | 2000-118860 | 4/2000 |
| JP | 2002-316764 A | 10/2002 |

* cited by examiner

IMAGE FORMING APPARATUS AND METHOD

CROSS-REFERENCE TO RELATED APPLICATIONS

The present application is a divisional of application Ser. No. 10/819,197, filed on Apr. 7, 2004, which claims priority to Japanese Patent Application Nos. 2003-105566, filed Apr. 9, 2003, and JP 2004-029559, filed Feb. 5, 2004, the entire contents of each of which are incorporated herein by reference.

BACKGROUND OF THE INVENTION

1. Field of the Invention

The present invention generally relates to image forming apparatuses and, more particularly, to an image forming apparatus such a printer having a saddle-stitching and center-folding function of printed sheets.

2. Description of the Related Art

Image outputting apparatuses such as a copy machine or a printer have become multi-functioned, and many image-outputting apparatuses are equipped with a memory device that can store a large amount of image data. Additionally, with such a multi-functionalization of the image outputting apparatuses, a post-processing apparatus has been diversified in its function such as a stapling function to staple output print papers.

As one of such techniques, Japanese Laid-Open Patent Application No. 11-151837 suggests a print apparatus having a stapling function, which performs a printing operation while canceling the stapling function if a number of print papers exceeds a number of sheets which can be stapled. Additionally, Japanese Laid-Open Patent Application No. 11-189365 suggests an image process post-processing apparatus, which determines whether or not a stapling can be applied, and prohibit a stapling operation if it is determined that a stapling is not applicable, and ejects print papers in a stapling part onto an eject tray. Further, Japanese Laid-Open Patent Application No. 9-183558 suggests a sheet post-processing apparatus having the same function as mentioned above.

Furthermore, Japanese Laid-Open Patent Application No. 2000-118860 suggests a technique to perform a saddle stitch process, which staples central portions of print papers in a paper feeding direction in addition to an end-stitching process, which staples an end portion of print papers. In such a saddle stitching process, print papers are temporarily conveyed to a stacking tray so as to align the print papers for stapling. Then, if a number of print papers is within a limit number for saddle stitching, the saddle stitching process is performed. On the other hand, if the number of print papers exceeds the limit number for saddle stitching, the print papers are ejected from the stacking tray to an outside tray without performing the saddle stitching process at that time.

In a conventional image forming apparatus, which performs such a saddle-stitching operation, if a number of sheets of printed paper temporarily stacked on the stack tray exceeds a maximum saddle-stitching number, the printed papers stacked on the stack tray is ejected therefrom and, thereafter, subsequent printed papers are stacked on the stack tray. For this reason, it takes a time to determine whether or not the number of printed papers stacked on the stack tray exceeds the maximum saddle-stitching number in addition to a time to stack the printed papers on the stack tray. Thereby, a processing time of the saddle-stitching operation is long, which lowers a productivity of the image forming apparatus. Moreover, in order to temporarily stack the printed papers on the stack tray, when the saddle stitching operation is not performed, a motor, which is not required to operate when performing the saddle-stitching operation, is unnecessarily driven, which results in an unnecessary consumption of electric power. Furthermore, since the printed papers are not bound if the printed papers are ejected from the stack tray to the outside tray, the printed papers are offset from each other and it is difficult to achieve a sufficient alignment.

SUMMARY OF THE INVENTION

It is a general object of the present invention to provide an improved and useful image forming apparatus in which the above-mentioned problems are eliminated.

A more specific object of the present invention is to provide an image forming apparatus which achieves a reduction in power consumption when performing a saddle-stitching operation and improves a productivity.

It is another object of the present invention to provide an image forming apparatus which can provide an excellent paper alignment when a saddle-stitching operation is not performed.

In order to achieve the above-mentioned objects, there is provided according to one aspect of the present invention an image forming apparatus comprising: a memory device storing image data; image forming unit forming visible images on recording sheets in accordance with the image data stored in the memory device; post-processing unit collecting the recording media on which images are formed by the image forming unit on an individual copy basis to prepare a bundle of the recording sheets, performing a saddle-stitching process and a center-folding process on the bundle of the recording sheets, and ejecting the processed recording sheets onto a predetermined eject tray; at least one eject tray other than the predetermined eject tray onto which the recording media are ejected; and a system control part that determines whether or not a total number of the recording sheets corresponding to the image data when the image data is recorded on the recording sheets is within a limit number for the saddle-stitching process, and, when the total number of the recording sheets exceeds the limit number for the saddle-stitching process, ejecting the recording sheets onto the at least one eject tray other than the predetermined eject tray.

In the above-mentioned invention, when the at least one eject tray has a sorting function to sort the recording sheets, the system control part may control to eject the recording sheets, on which images are formed, after sorting for each copy. Additionally, a plurality of eject trays may be provided other than the predetermined eject tray, and when the tray selected when the total number of recording sheets exceeds the limit number for the saddle-stitching process, the system control part may select one of the plurality of eject trays that is not full as a tray onto which the recording sheets are ejected. Further, the system control part may eject the recording media while continuously selecting the one of the plurality of eject trays that is not full until all the recording media on which image are formed are ejected.

The image forming apparatus according to the present invention may further comprise a stapler performing an end-stitching process to staple along an end portion of the recording media.

Additionally, there is provided according to another aspect of the present invention a method of forming images on sheet-like recording media, comprising the steps of: storing image data in a memory device; forming visible images on recording media in accordance with the image data stored in the memory means; determining whether or not a total number of the recording media corresponding to the image data when the image data is recorded on the recording media is within a limit number for the saddle-stitching process; collecting the recording media on which images are formed on an individual copy basis to prepare a bundle of the recording media; ejecting, when the total number of the recording media exceeds the limit number for the saddle-stitching process, the processed recording media onto a predetermined eject tray having a function to perform the saddle-stitching process and a center-folding process on the bundle of the recording media; and ejecting, when the total number of the recording media exceeds the limit number for the saddle-stitching process, the recording media onto at least one eject tray other than a predetermined eject tray.

The above-mentioned image forming method according to the present invention may further comprise a step of sorting, when the at least one eject tray has a sorting function to sort the recording media, the recording media into a plurality of copies before ejecting the recording media. Additionally, a plurality of eject trays may be provided other than the predetermined eject tray, and the method may further comprise a step of selecting, when the tray selected when the total number of recording media exceeds the limit number for the saddle-stitching process, one of the plurality of eject trays that is not full as a tray onto which the recording media are ejected. Further, the recording media may be ejected while the one of the plurality of eject trays that is not full is continuously selected until all the recording media on which image are formed are ejected.

The image forming method according to the present invention may further comprise a step of performing an end-stitching process to staple along an end portion of the recording media when the recording media are ejected onto the at least one eject tray other than the predetermined eject tray.

Additionally, there is provided according to another aspect of the present invention a method of forming images on sheet-like recording media, comprising the steps of: storing image data in a memory device; forming visible images on recording media in accordance with the image data stored in the memory means; determining whether or not a total number of recording media corresponding to the image data when the image data is recorded on the recording media is within a limit number for the saddle-stitching process; performing, when the total number of recording media exceeds the limit number for the saddle-stitching process, one of a dividing process and a consolidating process before ejecting the recording media, wherein the dividing process divides the total number of the recording medium into a plurality of copies, each of which contains a number of recording media equal to or smaller than the limit number for saddle-stitching process, and performs a face-attachment process on the image data on an individual copy basis; and the consolidating process consolidates a plurality of pages of the image data into one page so as to reduce the total number of recording media to be smaller than the limit number for saddle-stitching process; collecting the recording media on which images are formed on an individual copy basis to prepare a bundle of the recording media; ejecting the recording medium onto an eject tray having a function to perform the saddle-stitching process; and performing the saddle-stitching process and a center-folding process on the bundle of the recording media.

The image forming method according to the above-mentioned invention may further comprise a step of causing a user to select one of the dividing process and the consolidating process. Additionally, the image forming method may further comprise a step of performing an end-stitching process to staple along an end portion of the recording media when the total number of recording media exceeds the limit number for the saddle-stitching process.

Other objects, features and advantages of the present invention will become more apparent from the following detailed description when read in conjunction with the accompanying drawings.

DETAILED DESCRIPTION OF THE PREFERRED EMBODIMENTS

Figure 1:
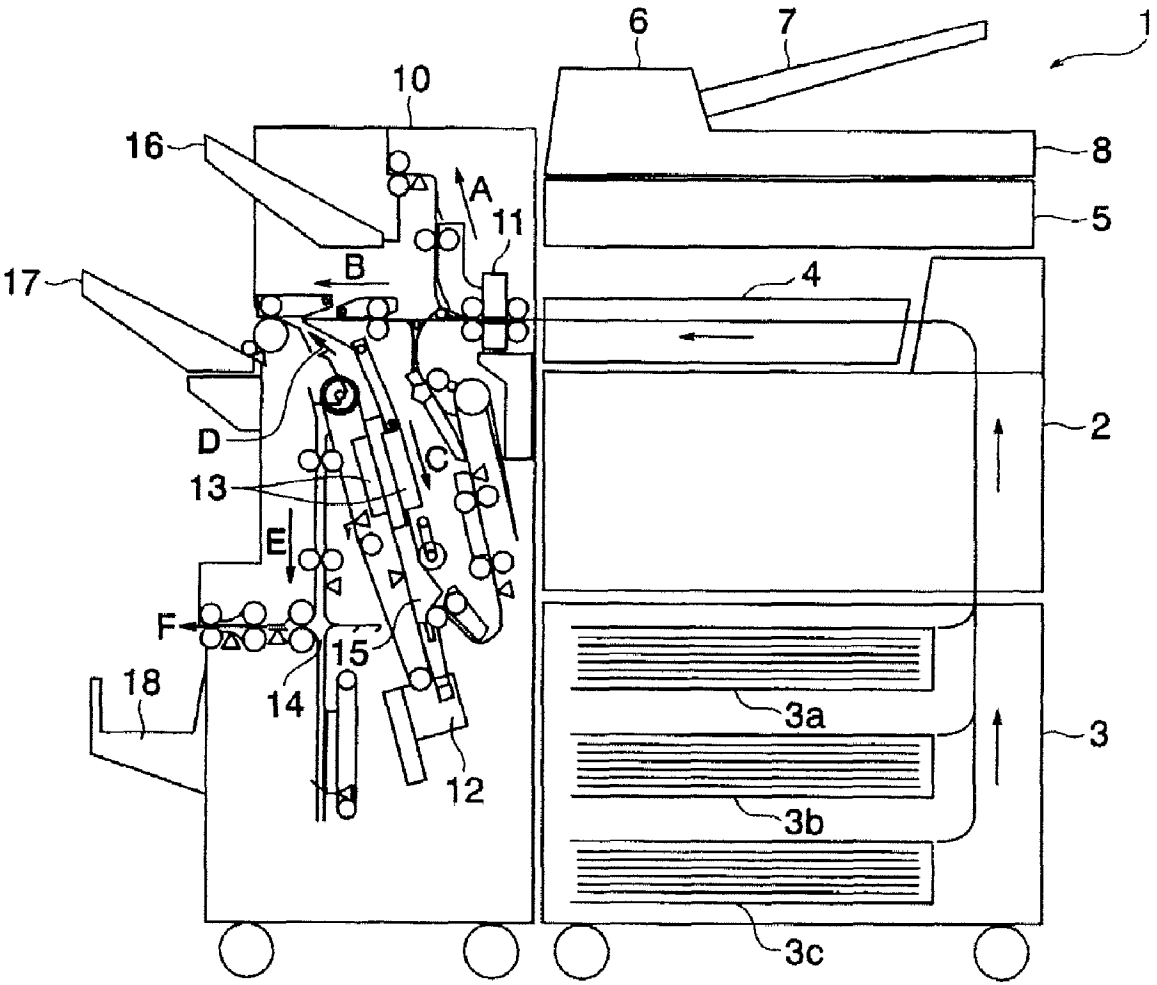
FIG. 1 is an illustration showing an entire structure of a copy machine according to an embodiment of the present invention.

A description will now be given below, with reference to the drawings, of an embodiment of the present invention. FIG. 1 is an illustration showing an entire structure of a copy machine 1, which is an image processing apparatus according to an embodiment of the present invention.

The copy machine 1 shown in FIG. 1 is a so-called digital multi function peripheral (MFP) unit having a copy function, a printer function and a facsimile function. The copy machine 1 is fundamentally constituted by a main unit 2, a paper feed unit 3, a relay unit 4, a scanner 5, an automatic reverse document feeder (ARDF) 6 and a post-processing unit 10. The main unit 2 is located on the paper feed unit 3. The relay unit 4 is placed on a paper eject side (upper left side in FIG. 1) of the main unit 2. The scanner 5 is placed above the main unit 2 and the relay unit 4. The ARDF 6 is located on the upper part of the scanner 5. The post-processing unit 10 is located on a side of the stacked main unit 2, the relay unit 4, the scanner 5 and the ARDF 6, and is connected via a paper eject port.

The ARDF 6 separates a plurality of documents placed on a document table 7 one sheet by one sheet, and sequentially feeds each sheet of the documents to a document reading surface of the scanner 5. Then, the ARDF 6 ejects the document sheets to a paper eject tray 8 after completion of reading of each sheet of documents.

The scanner 5 irradiates a light from a light source lamp onto a sheet of the documents placed on the document reading surface of a contact glass or the like. The light reflected by the sheet of documents is incident on a photoelectric transducer, which may consist of a charge coupled device (CCD)). An image on the sheet of documents is read by carrying out a photoelectric conversion by the photoelectric transducer, and the resultant image data is output to the main unit 2. The document sheets can be set on the scanner 5 by opening and closing the ARDF 6. The ARDF 6 has a function to serve as a pressing board, which presses the document sheet placed on the document reading surface, against the document reading surface. The paper feed unit 3 is provided with a plurality of paper feed cassettes 3*a*, 3*b* and 3*c*, each of which accommodates a plurality of print papers as recording sheets or sheet-like recording media. The paper feed unit 3 conveys the print papers to the main unit 2 from the feed cassettes 3*a*-3*c* according to a print paper selected an operation unit (not shown).

The main unit 2 is provided with an image forming unit (image forming means) using an electrophotography. The image forming unit (image forming means) of the main unit 2 forms an image on a print paper fed by the paper feed unit 3 in accordance with image data generated by the scanner 5 or data transmitted from an external apparatus (not shown in the figure) such as a personal computer. The main unit 2 conveys the print papers, on which the images are formed, to the post-processing apparatus 10 through the relay unit 4.

The post-processing unit 10 (post-processing means) accommodates a punch unit 11, a stapler 12 for end-stitching, a stapler 13 for saddle stitching (a staple processing part), a double-up unit 14, a stack tray 15, etc. Additionally, the post-processing unit 10 is provided with conveyance paths A-F that comprise rollers, guide plates, etc., so as to convey printed papers to the aforementioned parts. The conveyance paths A-F are provided with sensors, which detect the conveyance state of the printed paper in each of the conveyance paths A-F. Moreover, the post-processing unit 10 is provided with a proof tray 16, a shift tray 17 and a saddle-stitching eject tray (staple eject tray) 18 on the side thereof in that order from above.

The post-processing unit 10 can be set in various kinds of modes according to a kind of post-processing applied to the printed paper on which an image was formed. These modes contain a proof mode, a shift mode, an end-stitching mode and a saddle-stitching mode. In the proof mode, printed papers conveyed from the relay unit 4, for example, are ejected onto the proof tray 16 through the conveyance path A. In the shift mode, printed papers conveyed from the relay unit 4 are conveyed to the shift tray 17 through the conveyance path B. In the end-stitching mode, printed papers conveyed from the relay unit 4 are fed to the stack tray 15 through the conveyance path C, a paper aligning process is applied, a stapling process is applied by the stapler 12 for end-stitching, and, finally ejected onto the shift tray 17 through the conveyance path D. In the saddle-stitching mode, print papers conveyed from the relay unit 4 are aligned on the stack tray 15 through the conveyance path C, stapled by the stapler 13 for saddle stitching, a double-up process is applied by being passing through the conveyance path E, and, finally, ejected onto the saddle-stitching eject tray 18. The post-processing unit 10 can perform a sorting operation in the shift mode.

Figure 2:
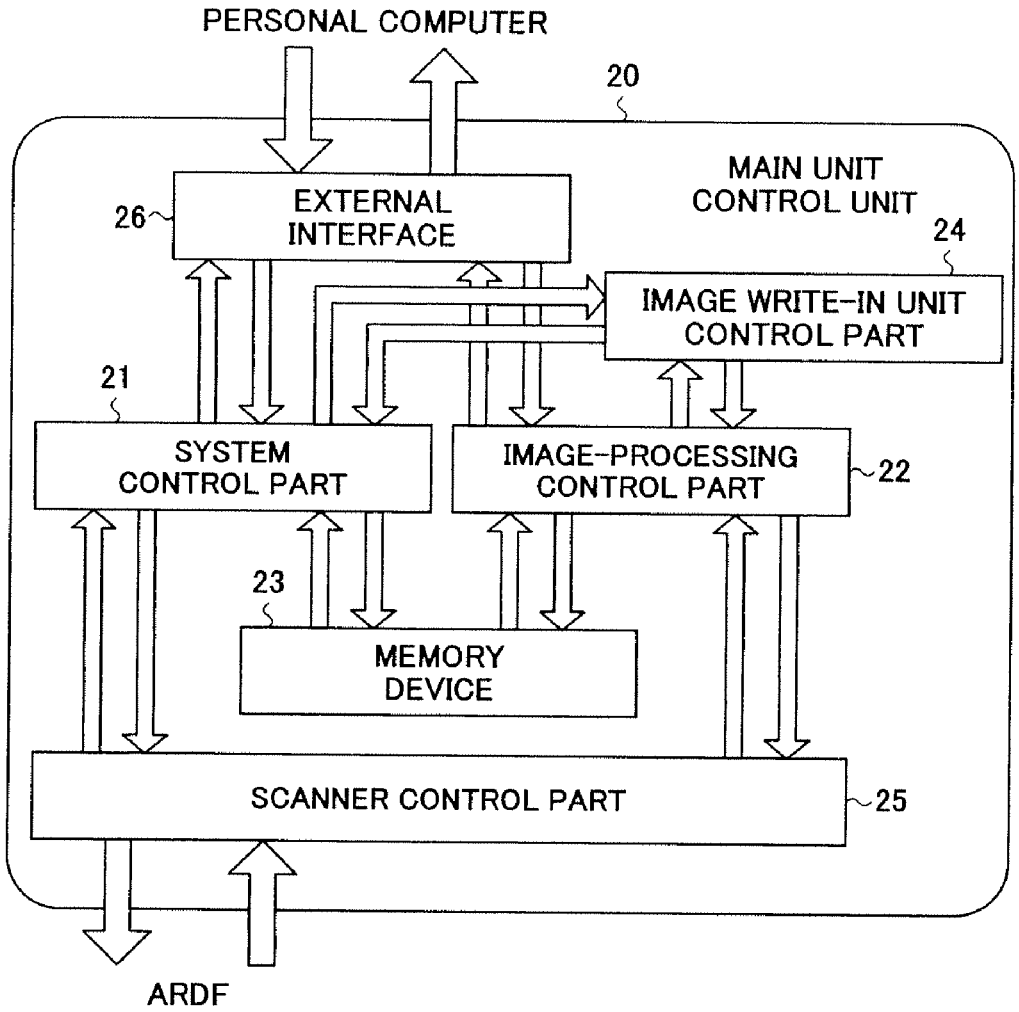
FIG. 2 is a block diagram of a main unit control unit provided in the copy machine shown in FIG. 1.

The main unit 2 is provided with a main unit control unit such as shown in FIG. 2. The main unit control unit 20 is provided with a system control part 21, a picture-processing control part 22, a memory device (memory means) 23, an image write-in unit control part 24, a scanner control part 25, an external interface 26, etc.

The system control part 21 controls an operation of the entire copy machine 1 including the post-processing unit 10, and performs a copy process and a post-processing control process mentioned later. The external interface 26 is connected to an external apparatus such as a personal computer directly or through a network such as a local area network (LAN). The external interface 26 operates under a control of the system control section 21 so as to send image data of an original document, which is read by the scanner 5, by exchanging commands with the external apparatus, and receive image data from the external apparatus and transfer the received image date to the image processing control part 22.

The scanner control part 25 controls the operations of the scanner 5 and the ARDF 6 under the control of the system control part 21 so as to cause the ARDF 6 to convey original document and cause the scanner 5 to read images on the conveyed original document, and transfers image data of the original document sent from the scanner 5 to the image processing control part 22. The image write-in unit control part 24 controls operations of the image formation part of the main unit 2 under the control of the system control part 21 so as to cause the image formation part to from an image on a print paper in accordance with the image data transferred from the image processing control part 22. The image processing control part 22 applies necessary processes to the document image data read by the scanner 5 and supplied by the scanner control part 25 or data sent from an external apparatus and supplied by the external interface 26, and store the data in the memory device 23. Additionally, the image processing control part 22 transfers image data to be stored in the memory device 23 to the image write-in unit control part 24 or the external interface 26 under the control of the system control part 21. The system control part 21 controls each part of the copy machine 1 so as to perform a fundamental process as a copy machine, and performs a post-processing control process mentioned later.

The copy machine 1 determines whether or not a stapling operation can be applied in accordance with an amount of data stored in the memory device 23 when performing a saddle-stitching process using the stack tray 15 by the post-processing unit 10. If the copy machine 1 determines that the stapling operation cannot be applied, printed papers are ejected onto a tray other than the saddle-stitching eject tray 18. It should be noted that although a description will be given below of a case where the original document is read by the scanner 5 and an image formation is performed in accordance with image data of the original document read by the scanner 5 and thereafter post-processing is performed, the same process can be applied to a case of data from an external apparatus supplied through the external interface 26. Additionally, although the description given below is directed to a case where the system control part 21 controls a series of processes, other processing parts such as an additional processing part may perform such a series of processes.

Figure 3:
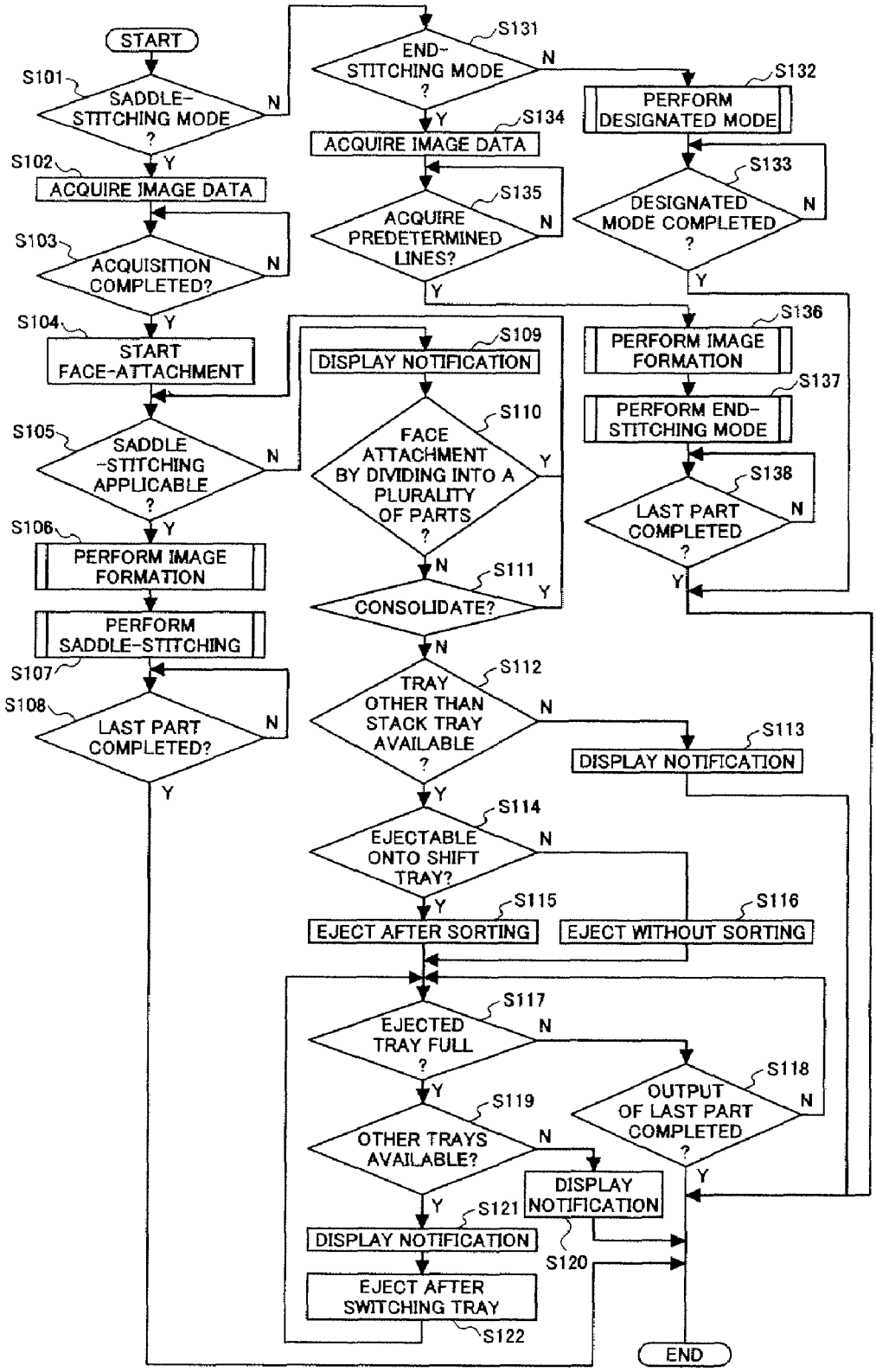
FIG. 3 is a flowchart of an image forming operation and a post-processing process performed by the copy machine shown in FIG. 1.

In the copy machine 1, original documents are set in the ARDF 6, as shown in FIG. 3, and a desired operation mode is set. Then, after a start key is pressed, the system control part 21 determines whether or not the saddle-stitching mode using the stack tray is selected (step S101). If the saddle-stitching mode is selected, the system control part 21 starts to acquire image data to be printed out and accumulates the image data in the memory device 23 (step 102). The image data is sent from the personal computer (hereinafter, abbreviated as PC) through the communication means when data from the PC is to be printed. If the data read by the scanner is to be printed, the image data is sent from the scanner 5. For example, if the image data from the scanner is to be printed, the system control part 21 controls operations of the ARDF 6 and the scanner 5 through the scanner control part 25 so as to cause the ARDF 6 to feed the original documents to the scanner 5 on an individual sheet basis and cause the scanner 5 to read the original documents. Subsequently, the image processing control part 22 applies necessary image processes to the image data acquired by the scanner 5 and causes the memory device 23 to store the image data, and checks whether or not the reading of all the original documents has been completed. If the image data is data from the PC, the image processing control part 22 checks whether or not all the image data from the PC has been acquired (step S103).

Figure 4:
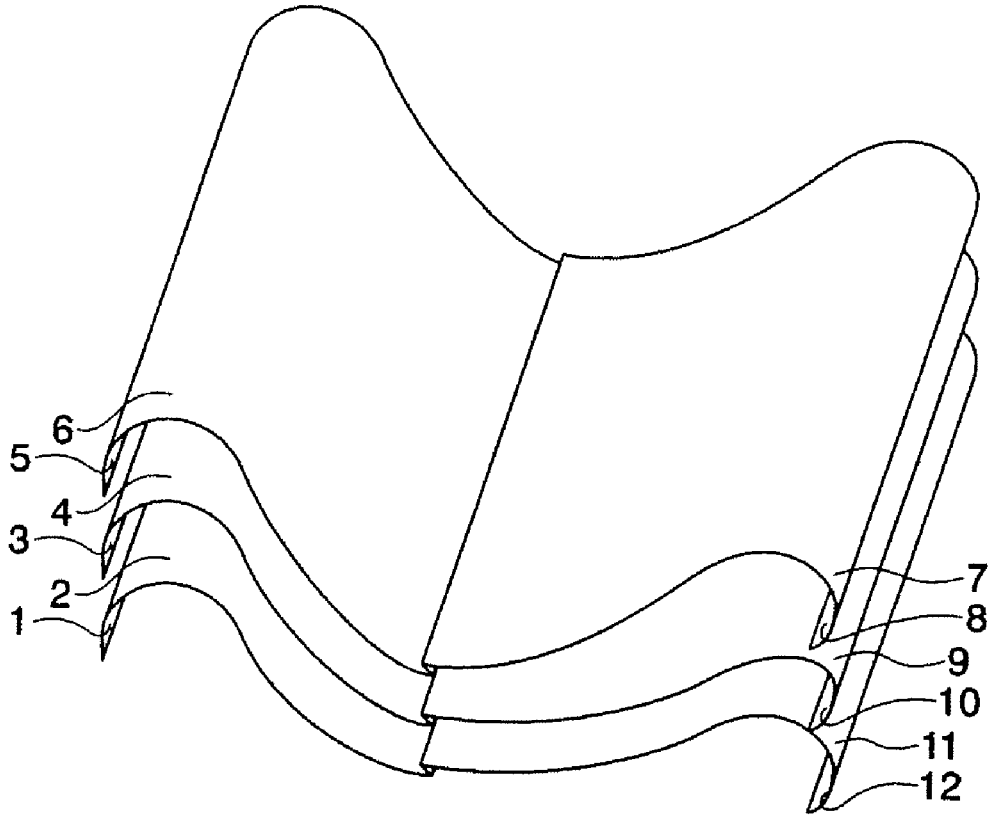
FIG. 4 is an illustration for explaining a face-attachment process.

After the reading of all the original documents has been completed in step S103, the systems control part 21 applies a face-attachment process (step S104). Thereafter, the system control part 21 calculates a total number of sheets to print from an amount of image data accumulated in the memory device 23, and determines whether or not the total number of sheets to print are the designated paper size and can be stapled with the saddle-stitching (step S105). The face-attachment process is a process to change a memory assignment so that printed papers are arranged in an order of pages, that is, an order from page 1 to page 12, when the printed papers are saddle-stitched and center-folded as shown in FIG. 4. In FIG. 4, page numbers are indicated simply as numbers 1-12.

If it is determined in step S105 that the total number of sheets to print is within the limit of saddle-stitching, the system control part 21 starts the image forming process in accordance with the face-attached image data (step S106). Then, the system control part 21 performs the designated saddle-stitching staple process (step S107). Then, the printed papers are ejected on an individual sheet basis, and after the saddle-stitching and paper eject are completed to the end (step S108-Y), operation of the process is ended.

On the other hand, if it is determined in step S105 that the total number of sheets to print is beyond the limit of saddle-stitching, the system control part 21 performs a notification display process to notify the user of the fact that the saddle-stitching staple process cannot be performed (step S109). Furthermore, the system control part 21 displays whether to divide the number of pages, which cannot be stapled, into a plurality of parts (step S110) or consolidate a number of pages (step S111), so as to let the user select one of them. When the user designates the face-attachment process of the plurality of parts and also designates a dividing process to divide the pages into a number of parts (step S110-Y), the system control part 21 checks whether or not a number of sheets in each of the parts (copies) divided in step S105 is within the limit of saddle-stitching. If the saddle-stitching can be applied, the system control part 21 performs the process of step S106 and the processes of the subsequent steps. On the other hand, if the saddle-stitching cannot be applied, the designation of the number of parts to divide is designated again in step S109 and step S110, and if it is determined in step S105 that the saddle-stitching is applicable, the system control part 21 performs the process of step S106 and the processes of subsequent steps.

If the face-attachment of the plurality of divided parts (copies) is not selected in step S110 (step S110-N), and if a consolidating process is selected, that is, if a process to incorporate images corresponding to a plurality of pages into one page is selected in step S111 (step S110-Y), the process returns to step S105. Then, the system control part 21 checks whether or not a saddle-stitching staple can be applied with the selected number of collected pages. If the saddle-stitching is applicable, the process of step S106 and the processes of subsequent steps are selected. On the other hand, if the stitching cannot be applied, the number of pages to be consolidated is changed in step S111, and when the number of pages becomes within the limit of saddle-stitching, the system control part 21 performs the process of step S106 and the processes of subsequent steps.

When neither the face-attachment of a plurality of divided parts nor the consolidation is selected in steps S110 and S111 (including a case where no selection is made within a predetermined time period), the system control part 21 checks whether or not there is a tray onto which the printed papers can be ejected other than the stack tray, that is, whether or not the proof tray or the shift tray is empty (step S112). When printed papers are placed on either of the trays 16 and 17 and there is no empty tray onto which the printed papers can be ejected, a notification such as, for example, "No tray available. Please remove printed papers on the tray." is displayed on the display unit (step S113), and the process is ended.

On the other hand, when it is determined in step S112 that there is a tray onto which printed papers can be ejected other than the stack tray 15, the system control part 21 checks whether or not the empty trays onto which the printed papers can be ejected is a sortable tray, that is, whether or not the tray is the shift tray 17 (step S114). If the empty tray is a sortable tray, the system control part 21 starts a paper eject operation to perform a sorting process for the printed papers (step S115). If the empty tray is not a sortable tray, that is, if the empty tray is a proof tray 16, the system control part 21 starts a paper eject operation without performing a sorting operation (step S116). That is, the system control part 21 reads the image data from the memory device 23, transfers the image data to the image write-in unit control part 24, and controls the image forming unit through the image write-in unit control part 24 to perform the image forming operation on a print paper. Moreover, the system control part 21 controls an operation of the post-processing unit 10, and starts a paper eject operation with or without a sorting operation.

After the paper eject operation is started, the system control part 21 checks whether or not the paper eject tray 16 or 17 is full (step S117). When the trays are not full, the system control part 21 checks whether or not an output of the last part of the image data has been completed (step S118). If the output of the last part is not completed, the process returns to step S117 where it is checked whether or not the used eject trays 16 or 17 is full. If the discharge tray 16 or 17 currently used is full in step S117, the system control part 21 checks whether or not there is another empty tray (step S119). If there is no empty tray available, a notification indicating that there is no empty tray is displayed (step S120), and the paper eject operation is ended.

If there is an empty tray (tray 16 or 17) onto which the printed papers can be ejected, the system control part 21 displays a notification indicating that the paper eject tray is full (step S121). Then, the empty tray 16 or 17 is switched as the tray used for the paper eject, and the paper eject operation is started (step S122). Then, the process returns to step S177 so as to perform the series of processes beginning from the check as to whether or not the switched eject tray 16 or 17 is full (steps S117-S122), and after completion of output of the last part of the image data in step S118, the process is ended.

Moreover, if the saddle-stitching mode is not selected in step S101, it is checked whether or not the end-stitching mode is selected (step S131). If the end-stitching mode is not selected, the system control part 21 performs the process of the mode designated in step S132, and ends the whole process when the process of the mode designated in step S132 is completed (step S133-Y).

If the end-stitching mode is selected in step S131, the system control part 21 acquires the image data in step S134. After the image data corresponding to predetermined number of lines is acquired (step S135-Y), the image forming operation is started (step S136). Then, the process of the end-stitching mode is performed (step S137) so as to end-stitch on an individual part basis, and the process is ended when the end-stitching of the last part is completed (step S138).

As mentioned above, the copy machine 1 according to the present embodiment stores the input image data in the memory device 23 temporarily. Then, the copy machine 1 performs a face-attachment process according to a number of pages on which the image formation of the image data is performed. The image forming unit of the main unit 2 of the copy machine 1 perform an image formation on the print papers corresponding to a designated number of copies based on the image data on which the face-attachment process has been performed. The printed papers of the plurality of copies are arranged on the stack tray 15, and are bundled in each of the plurality of copies and sequentially stacked on an individual copy basis. The bundled and stacked printed papers are subjected to the saddle-stitching process by the saddle-stitching stapler 13, and, thereafter, subjected to the center-folding process and ejected onto the saddle-stitching eject tray 18. At this time, it is determined whether or not the total number of printed papers corresponding to the image data stored in the memory device 23 is within a number of papers which the saddle-stitching stapler 13 is capable of stapling. If it is determined that the number of papers exceeds the limit of number of papers which can be stapled, one of the trays 16 and 17 other than the saddle-stitching tray 18 is selected and the printed papers on which images are formed by the image forming unit are ejected onto the selected one of the trays 16 and 17 from the first copy. Alternatively, if it is determined that the number of papers exceeds the limit of number of papers which can be stapled, a process of saddle-stitching is performed by reducing the number of papers to be stapled. That is, in this embodiment, each copy is further divided into a plurality of copies and the face-attachment process is applied to each of the divided copies, or the image data corresponding to a plurality of pages is reduced into data that can be printed on a single page, so that the number of printed papers to be bundled and stapled is reduced within a limit number of saddle-stitching. Thereby, it can be omitted to spend a time for receiving next printed papers, which time is required when performing an operation of ejecting the printed papers corresponding to one copy from the stack tray 15, which performs a stapling process, to the saddle-stitching eject tray 18, taking a time to receive next printed papers to receive a number of printed papers exceeding the limited number, performing an operation to eject the printed papers again from the stack tray 15 to the saddle-stitching eject tray 18, and repeating aforementioned process from one copy to a next copy until a desired number of copies are processed. Therefore, the productivity of the copy machine 1 is improved, and printing papers can be tidily placed on the tray 16 or 17 with sufficient convenience.

Moreover, in the present embodiment, the shift tray 17, which is capable of sorting printed papers, is provided as one of trays other than the saddle-stitching eject tray 18 onto which the printed papers can be ejected so as to eject the printed papers while sorting for each copy if the tray selected when stapling cannot be performed is the shift tray 17, which is capable of sorting. Therefore, the printed papers can be ejected on an individual copy basis and the productivity of the copy machine can be improved while improving convenience.

Furthermore, in the present embodiment, two trays 16 and 17 are provided other than the saddle-stitching tray 18 as trays onto which the printed papers can be ejected. Thus, the tray selection process of selecting one of the trays 16 and 17 as a tray for ejecting the printed papers if one of the selected trays 16 and 17, which was selected when stapling cannot be performed, becomes full is repeatedly performed until all the printed papers corresponding to the whole image data are ejected. Therefore, the image forming operation can be prevented from being stopped due to shortage of trays during the image forming operation, which improves availableness of the copy machine.

It should be noted that, in the present embodiment, although not illustrated, the above-mentioned control unit is provided on the upper surface of the scanner 5 at a front side of the ARDF 6.

The present invention is not limited to the specifically disclosed embodiments, and variations and modifications may be made without departing from the scope of the present invention.

The present application is based on Japanese priority applications No. 2003-105566 filed Apr. 9, 2003 and No. 2004-29559 filed Feb. 5, 2004, the entire contents of which are hereby incorporated by reference.

What is claimed is:

1. An image forming apparatus, comprising:

a memory device configured to store image data;

an image forming unit configured to form visible images on recording sheets in accordance with the image data stored in said memory device;

a post-processing unit configured to collect the recording sheets on which images are formed by said image forming unit on an individual copy basis to prepare a bundle of the recording sheets, perform a saddle-stitching process and a center-folding process on the bundle of the recording sheets, and eject the processed recording sheets onto a predetermined eject tray;

at least one eject tray other than said predetermined eject tray onto which the recording media sheets are ejected; and system control means for determining whether or not a total number of recording sheets corresponding to the image data when the image data is recorded on the recording sheets is within a limit number for said saddle-stitching process, and, when the total number of recording sheets is determined to exceed the limit number for said saddle-stitching process, performing a dividing process based on the determination before ejecting the recording sheets, wherein the dividing process divides the total number of the recording sheets into a plurality of copies, each of which contains a number of recording sheets equal to or smaller than said limit number for saddle-stitching process, and performing a face-attachment process on the image data on an individual copy basis before ejecting the recording sheets.

2. The image forming apparatus as claimed in claim 1, wherein said system control means permits a user to select the dividing process.

3. The image forming apparatus as claimed in claim 1, further comprising a stapler configured to perform an end-stitching process to staple along an end portion of the recording sheets.

4. An image forming method of forming images on recording sheets, comprising:

storing image data in a memory device; forming visible images on the recording sheets in accordance with the image data stored in said memory device;

determining whether or not a total number of recording sheets corresponding to the image data when the image data is recorded on the recording sheets is within a limit number for said saddle-stitching process;

performing, when the total number of recording media is determined to exceed the limit number for said saddle-stitching process, a dividing process based on the determination before ejecting the recording sheets, wherein the dividing process divides the total number of the recording sheets into a plurality of copies, each of which contains a number of recording sheets equal to or smaller than said limit number for said saddle-stitching process, and performs a face-attachment process on the image data on an individual copy basis;

collecting the recording media sheets on which images are formed on an individual copy basis to prepare a bundle of the recording sheets;

ejecting the recording sheets onto an eject tray having a function to perform said saddle-stitching process; and performing said saddle-stitching process and a center-folding process on the bundle of the recording media.

5. The image forming method as claimed in claim 4, further comprising:

allowing a user to select the dividing process.

6. The image forming method as claimed in claim 4, further comprising:

performing an end-stitching process to staple along an end portion of the recording media when the total number of recording sheets exceeds the limit number for said saddle-stitching process.

* * * * *